United States Patent [19]

Ettlinger et al.

[11] Patent Number: 4,527,743

[45] Date of Patent: Jul. 9, 1985

[54] SPRAY HEAD ASSEMBLY

[75] Inventors: Ralph Ettlinger, Glencoe; John A. Biela, Niles, both of Ill.

[73] Assignee: Amco Corporation, Chicago, Ill.

[21] Appl. No.: 533,606

[22] Filed: Sep. 19, 1983

[51] Int. Cl.[3] ..... B05B 9/00

[52] U.S. Cl. ..... 239/530; 239/562; 239/586; 239/588; 251/147; 251/238

[58] Field of Search ..... 239/562, 530, 586, 588; 251/147, 238, 243, 279, 176

[56] References Cited

U.S. PATENT DOCUMENTS

| | | | |
|---|---|---|---|
| 990,179 | 4/1911 | Wilson et al. | 239/586 |
| 3,022,015 | 2/1962 | Burch | 239/530 |
| 3,131,868 | 5/1964 | Coleman | 239/562 |
| 3,214,133 | 10/1965 | Rodgers et al. | 239/562 |
| 3,559,947 | 2/1971 | Sette | 251/147 |
| 3,637,143 | 1/1972 | Shames et al. | 239/530 |

*Primary Examiner*—Jeffrey V. Nase
*Assistant Examiner*—Michael J. Forman
*Attorney, Agent, or Firm*—Laff, Whitesel, Conte & Saret

[57] ABSTRACT

A spray head assembly is made primarily from a very few number of injection molded parts. Preferably a pair of elongated housing shells fit together in face-to-face confrontation, with a spring biased actuator arm or control lever pivotally mounted between them. The lever has a metal shaft extending therefrom, which passes through a flexible cone in a rubber bulkhead to maintain a waterproof seal. In front of the bulkhead is a solid plastic plate having mounted therein a reciprocally slidable member controlled by the lever. The sliding member contains a generally triangular or tapered opening having a sector of a circle for a base. Depending upon the position of the slide, the opening moves up or down to open or close a water passageway through the spray head. The sliding member first presents the apex of the opening to an associated sealing ring to minimize the abruptness of any change in discontinuity of water flow at the edge of the opening. The spray head delivers water from a generally rectangular pattern of spray holes.

14 Claims, 7 Drawing Figures

SPRAY HEAD ASSEMBLY

This invention relates to spray head assemblies, and more particularly, to spray heads for use on or in connection with dishwashing installations.

Spray heads associated with sinks, dishwashing and the like generally have a circular or round spray head pattern. Usually, they include metal parts, chrome plating and a complex mechanical construction. Very often, as many as twenty parts may be used in such a spray head assembly. Due to its complexity, this construction often requires frequent replacement of parts. Also, the circular spray pattern tends to provide a form of mutually interferring water flow on the sprayed object, by which the dishes are gently bathed. While such a spray may be good for removing soap, it is not overly efficient for removal of any residue which tends to be stuck to the dish. Another problem which has been encountered relates to a use in spray heads of metal parts which attract mineral deposits, corrosive forces, and the like. The metal is both heavier and more expensive than comparable plastic would be and because it is in direct contact with the hot water, often becomes uncomfortably hot to handle.

Accordingly, an object of the invention is to provide new and improved spray heads. Here, an object is to provide a lightweight, low cost, mechanically dependable spray head with a superior water distribution pattern. In this conection, an object is to provide a sharp spray which tends to have a knife-like cutting quality.

Another object of the invention is to provide a more durable, simpler, non-corrosive spray head. Here, an object is to provide a spray head made entirely of injection molded plastic.

Still, another object is to provide an easy to use spray head which may be grasped in a number of different ways. Here, an object is to provide a more foolproof system which makes it easier to operate the spray head in a proper manner.

A further object is to provide a spray head that does not become uncomfortably hot to handle during use.

In keeping with an aspect of the invention, a spray head is made primarily from injection molded plastic parts. A pair of housing shells fit together in a face-to-face confrontation. Pivotally mounted between the housing shells is a spring biased lever or actuator arm, which has a metal shaft extending therefrom. The shaft passes through a flexible cone integrally formed as a part of a rubber bulkhead, which enables the lever to see-saw while maintaining a waterproof seal within a spray head compartment. In front of the bulkhead is a solid plastic plate having a reciprocally sliding member controlled by the see-sawing of the lever. The slide contains a generally triangular opening having a sector of a circle for a base, to open and close a water flow path without snagging on seal members. Depending upon the position of the slide, water is delivered from the spray head in a generally rectangular pattern of water flow.

A preferred embodiment of the inventive spray head is seen in the attached drawings, wherein.

Figure 1:
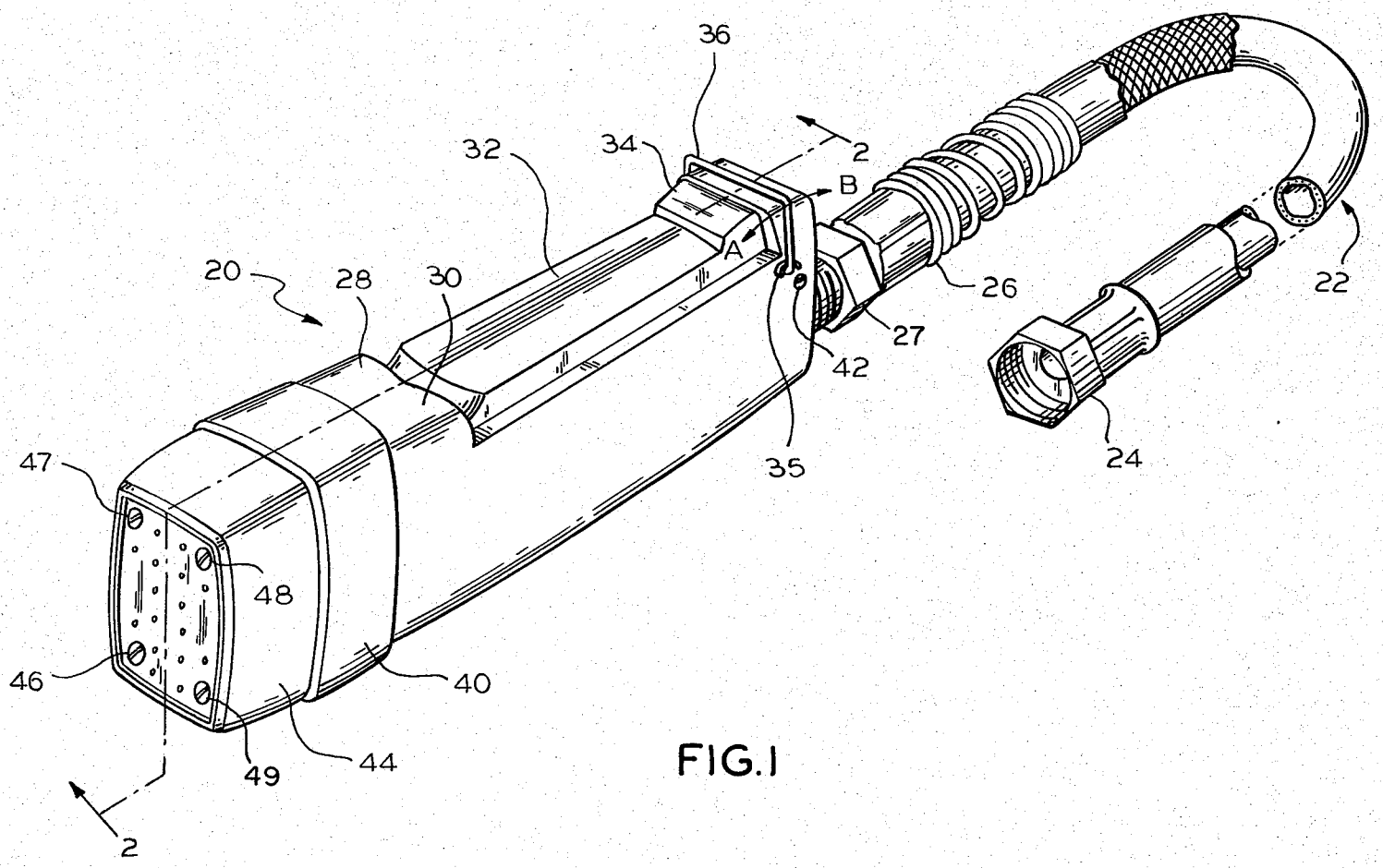
FIG. 1 is a perspective view of the inventive spray head with an attached water hose.

The spray head 20 is here shown as being connected to a hose 22, leading to a fitting 24 which may be connected to any suitable water pipe or faucet. A spring 26 surrounds the region where a fitting 27 on the hose joins the spray head in order to give it mechanical strength and stress relief without a loss of flexibility. A similar spring may be attached to the other end of the hose adjacent the connection to the water pipe or faucet.

In the preferred embodiment, the spray head 20 has two elongated housing shells 28, 30 with a spring biased lever or actuator arm 32 pivotally mounted between them. The actuator arm 32 has an upstanding boss 34 formed on an end remote from the pivot to act as a keeper for a U-shaped, wire spring locking member 36. The ends of member 36 snap into opposing holes in the housing shells 28, 30 so that it may swing in directions A, B. The locking member 36 is shown in FIG. 1 at the end of its excursion in direction B where it is out of the way and has no effect. Suitable detents 35 disposed on the sides of shells 28, 30 hold the keeper at the ends of its excursion in directions A and B. When the arm 32 is depressed and locking member 36 swings in direction A, it fits over and hooks behind the keeper 34 to hold the actuator arm 32 in an operated position.

The fronts of the housing shells 28, 30 fit into a rubber bulkhead 40 which surrounds them and holds them in place. The backs of the housing shells are secured in place by three screws 42. A spray head plate 44 is attached to the bulkhead 40 by four screws 46, 47, 48 and 49.

Air space 31 (FIG. 2) formed in housing shells 28, 30 helps to insulate spray head 20 so that the hot water flowing through the pipe 98 does not overheat shells 28, 30 and make it uncomfortable to handle the device.

In operation, the fitting 24 is attached to any suitable pressurized water supply. A person holds the spray head 20 and moves the arm 32 downwardly (as viewed in FIG. 1) to cause water to issue from spray head plate 44. When released, the arm 32 moves up under a spring bias to stop the spray.

Figure 2:
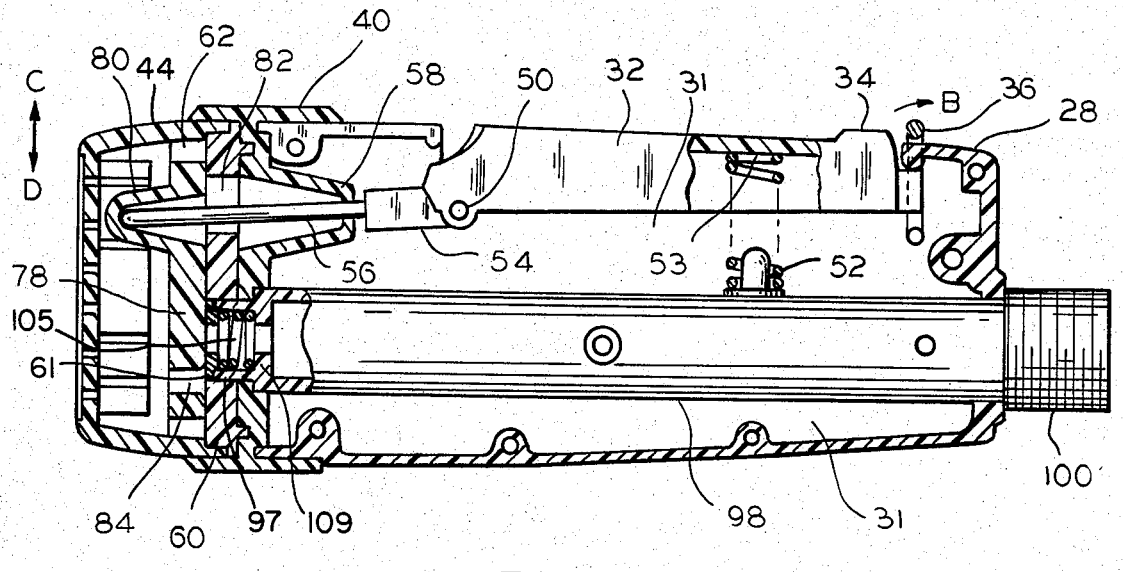
FIG. 2 is a cross section taken along line 2—2 of FIG. 1, showing the valve in a closed position.
Figure 3:
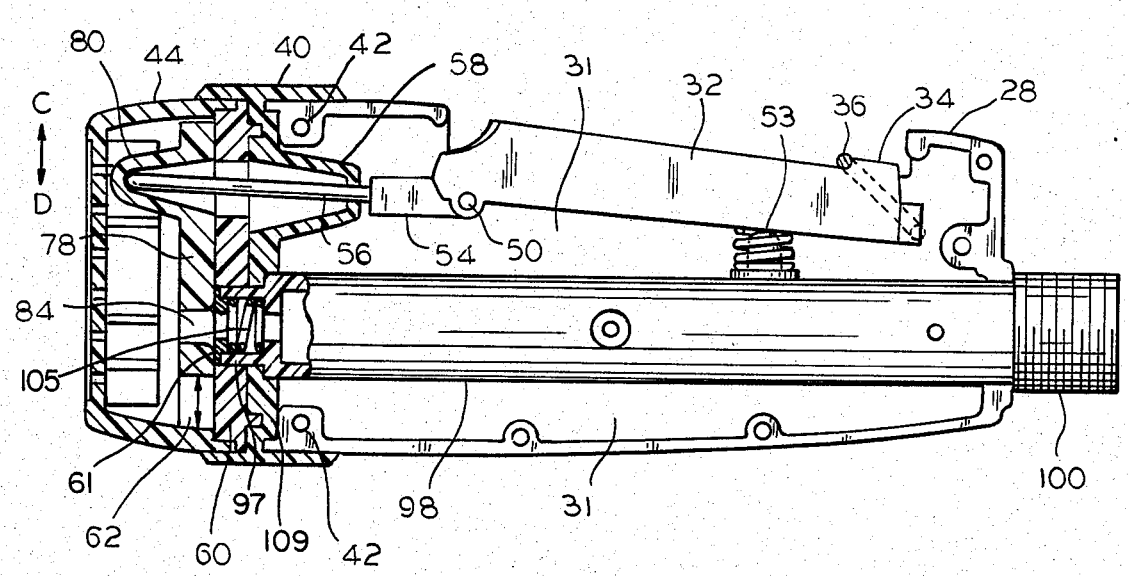
FIG. 3 is a similar cross section showing the valve in an opened position, with a locking member in place to hold the valve open.

FIGS. 2 and 3 show the construction inside the housing, the valve being closed in FIG. 2 and open in FIG. 3. The actuator arm 32 includes a handle with shaft 56 extending therefrom and is pivotally attached to the housing at 50, by two pins which are integrally molded on the actuator arm to fit into recesses formed inside the housing shells. A coiled spring 52 is positioned under the distal end of the handle part of the actuator arm 32, to bias it to an elevated or unoperated position. A boss 53 is formed on the inside surface of arm 32 to hold spring 52 in place.

The front end of actuator arm 32 terminates in a socket 54, integrally molded therein. A metal rod 56 is inserted into the socket 54, to move as a unit with the arm 32. The arm 32 and rod 56 see-saw about the pivot 50 under either the hand applied pressure of an operator pushing on arm 32 or the return force of spring 52.

Rod 56 projects through a conical bushing 58 which is an integral part of the rubber bulkhead 40. The bulkhead 40 surrounds the ends of housing shells 28, 30 and spray head plate 44 to keep the water in the spray head end and out of the control end of the housing. The elasticity of the conical bushing 40 enables the rod 56 to move up or down without interfering with the bulkhead seal.

Figure 4:
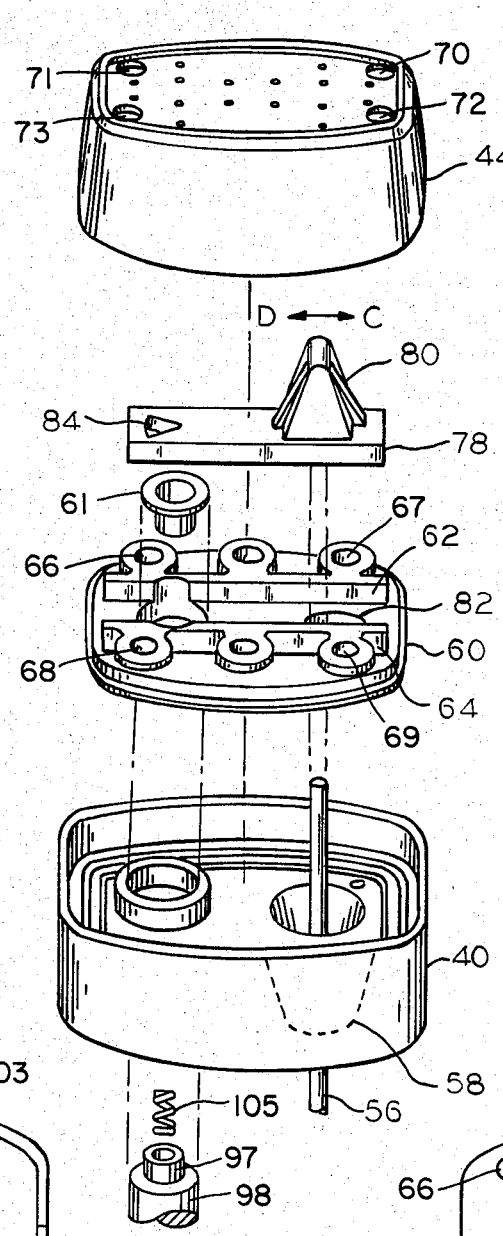
FIG. 4 is a perspective and exploded view of the spray head assembly.
Figure 6:
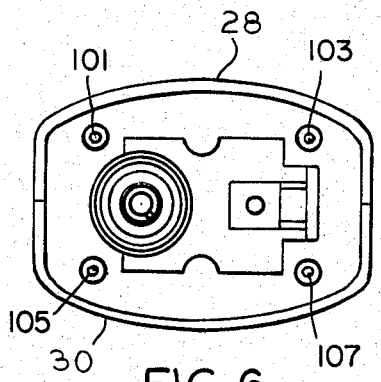
FIG. 6 is a front view of the housing shells fitted together.
Figure 7:
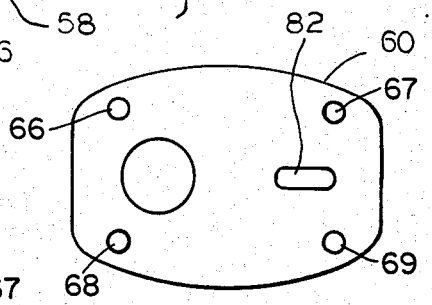
FIG. 7 is a back view of the valve support plate.

FIG. 4 is an exploded view of the end of the spray head assembly. A rigid valve support plate 60 has a pair of spaced parallel upstanding guide ways 62, 64 formed therein, along with holes 66, 67, 68 and 69 for receiving spray head plate mounting screws 46, 47, 48 and 49 (FIG. 1). The screws pass through holes 70, 71, 72, and 73 in plate 44, holes 66, 67, 68 and 69 in plate 60 and thread into holes 101, 103, 105, and 107 (FIG. 6) in shells 28 and 30.

A sliding valve plate 78 rides between the upstanding guide ways 62, 64. The valve plate 78 has a socket 80 for receiving an outer end of rod 56, which passes through a slot 82 in plate 60. When the outer end of rod 56 moves in direction C, plate 78 slides in direction C and when rod 56 moves in direction D, plate 78 slides in direction D.

A hole 84 is formed in plate 78 to open or close a passageway for water to flow through. This hole 84 is tapered in shape, preferably triangular, with an apex on the end which is closest to the water passageway and an arcuate base on the other end. A wear-resistant bushing 61 (FIG. 2,3) made of a material with a low coefficient of friction such as TEFLON fits over and inside the seal end 97 of pipe 98 adjacent valve plate 78 to act as an interface between the seal end 97 and the valve plate 78. Bushion 61 ensures that the valve plate smoothly slides over seal end 97 without catching or producing unnecessary wear on the seal. Also, the side of the hole 84 that is next to the valve support plate 60 is preferably counter sunk or recessed and rounded so that no edges with sharp corners snag, catch or otherwise impinge on the wear resistant bushing 61 as the valve plate 78 slides over bushing 61 and seal 97 (FIGS. 2,3).

Figure 5:
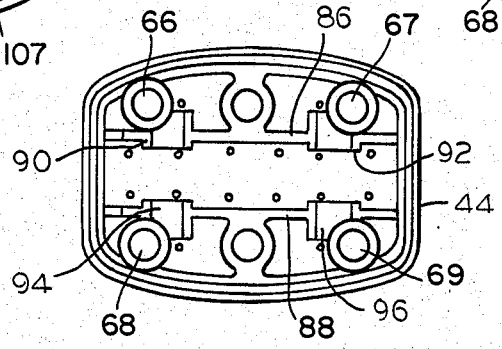
FIG. 5 is a back view of the perforated spray plate showing members for distributing water to the outlet holes in the spray head.

The inside of the spray head plate 44 contains divider walls 86, 88 (FIG. 5) which bear against the sliding valve plate 78 to hold it firmly in place against plate 60 and Teflon bushing 61 and between guide walls 62, 64. The water completely fills the spray head plate 44 when valve hole 84 on sliding valve plate 78 is in the water flow position.

A pipe 98 (FIGS. 2, 3) extends from a threaded end 100 which receives a fitting 27 (FIG. 1) to an opposite end 109 which has and end seal 97 that holds bushing 61. The hose fitting 27 (FIG. 1) makes a connection with the threaded end 100. The end 109 includes the seal end 97 which together with bushing 61 fits tightly behind and abuts the sliding valve plate 78 and prevents water from leaking behind the sliding valve plate 78. This end seal is a reduced diameter on pipe 98 with an O-ring or a which may be spring biased. End 109 of pipe 98 is counterbored to receive bushing 61 and spring 105 which urges bushing 61 against sliding valve plate 78 to ensure that bushing 61 remain in contact with plate 78. The apex of triangular opening 84 slides first over the seal 97 to minimize the abruptness of any change in discontinuity in water flow.

If desired, stops may be provided so that when the mounting screws 46, 47, 48 and 49 are tightened, they will not squeeze and distort rubber bulkhead 40 due to uneven pressure applied by the screws. Distortion of the bulkhead 44 may cause support plate 60 and slide valve 78 to sit unevenly with respect to pipe end 109 and seal 97, resulting in excessive wear on seal 97. Thus, the stops are positioned to help ensure that sliding valve plate 78 sits evenly with respect to bushing 61 and seal 97 to avoid unnecessary wear.

The operation of the spray head should be apparent by an inspection and comparison of FIGS. 2, 3. In FIG. 2, spring 52 biases actuator arm 32 which pivots around point 50 and lowers the end of rod 56 (in direction D). As the rod end moves downwardly, valve plate 78 slides down and the hole 84 passes away from the opening through pipe 98. The bushing 61 remains pressed against the back of the sliding plate 78 to keep water from leaking.

When the actuator arm 32 is pushed downwardly against the bias of spring 52 to pivot about point 50, the distal end of rod 56 moves up in direction C. Valve plate 78 slides up and hole 84 moves in front of the bushing 61, which continues to prevent water from leaking out the back of plate 78. Water passes through hole 84 and out the holes in the shower head plate 44. Locking member 36 may be moved in direction A to hold the actuator arm 32 in the operated position.

When the arm is released, spring 52 returns it to the unoperated condition (FIG. 2).

Those who are skilled in the art will readily perceive how to modify the invention. Therefore, the appended claims are to be construed to cover all equivalent structures which fall within the true scope and spirit of the invention.

The claimed invention is:

1. A spray head assembly comprising a housing shell, spring biased actuator lever arm means including a handle having a shaft extending therefrom, means for pivotally mounting said arm means in the housing shell so that said shaft has a see-saw action responsive to a manual movement of said handle, bulkhead means including at least a flexible cone for sealing the front of said housing, said shaft on said lever means passing through said flexible cone in said bulkhead means which enables the actuator lever arm and shaft to see-saw about said pivotal mounting while maintaining a waterproof seal within a spray head compartment, valve means in front of the bulkhead which is operated between opened and closed positions by the see-sawing of said actuator lever arm means, a pressurized water passageway being opened and closed by said valve means, and means at the output of said spray head for delivering a spray pattern of water flow responsive to an opening of said water passageway.

2. The spray head assembly of claim 1 wherein said housing shell comprises a pair of shells which fit together in face to face confrontation.

3. The spray head assembly of claim 1 wherein said valve comprises a sliding valve plate which contains a generally tapered shaped opening.

4. The spray head assembly of claim 3 wherein said tapered shaped opening is triangular in shape.

5. The spray head assembly of claim 4 and seal means on the end of said pressurized water passageway, said triangular shaped opening passing apex first over said seal means as said valve plate slides to an open position.

6. The spray head assembly of claim 5 wherein a bushing is disposed between said seal means and said valve plate to act as an interface.

7. The spray head assembly of claim 5 wherein said sliding valve plate has a back side which is counter sunk and rounded to reduce wear on said seal.

8. The spray head assembly of claim 1 and means for delivering said spray in a rectangular pattern.

9. The spray head assembly of claim 1 and locking means for selectively holding said actuator lever arm means in an open position.

10. A spray head assembly comprising an elongated housing having a generally rectangular pattern of spray holes formed at one end thereof, actuator arm means at the other end of said elongated housing for controlling the flow of water through said pattern of spray holes, spring means for normally biasing said actuator arm to a position which shuts off the flow of water, pipe means having a sealing member at one end thereof for conveying water through said housing means to said spray holes, and a sliding valve means in front of said sealing member for opening and closing said pipe means responsive to movement of said actuator arm means, a bulkhead for sealing said housing to a plate containing said pattern of spray holes, said bulkhead including at least a conical flexible section in said bulkhead for transmitting actuator arm movement to said sliding valve means.

11. The spray head asssembly of claim 10 wherein said bulkhead is made of rubber-like material.

12. The spray head assembly of claim 10 and a hole formed in said sliding member for selectively opening said pipe, the edge of said hole being counter sunk and rounded to reduce wear on said sealing member.

13. The spray head assembly of claim 10 and an air space disposed within said housing to insulate said housing from said pipe means.

14. The spray head assembly of claim 13 and a boss formed on the inside of said actuator arm to hold said spring means in position.

* * * * *